US008959663B2

(12) United States Patent
Baacke

(10) Patent No.: US 8,959,663 B2
(45) Date of Patent: Feb. 24, 2015

(54) GLOVE WITH NON-BUNCHING PALM CONSTRUCTION

(75) Inventor: Dennis R. Baacke, Irma, WI (US)

(73) Assignee: JMI (USA) Ltd., Merrill, WI (US)

( * ) Notice: Subject to any disclaimer, the term of this patent is extended or adjusted under 35 U.S.C. 154(b) by 180 days.

(21) Appl. No.: 12/235,160

(22) Filed: Sep. 22, 2008

(65) Prior Publication Data

US 2009/0077714 A1 Mar. 26, 2009

Related U.S. Application Data

(60) Provisional application No. 60/974,230, filed on Sep. 21, 2007.

(51) Int. Cl.
*A41D 13/08* (2006.01)
*A41D 19/02* (2006.01)

(52) U.S. Cl.
CPC ..... *A41D 19/02* (2013.01)
USPC ..... 2/16

(58) Field of Classification Search
USPC ..... 2/16, 20, 161.2, 161.3
See application file for complete search history.

(56) References Cited

U.S. PATENT DOCUMENTS 3,251,067 A 5/1966 Shmikler
3,548,414 A * 12/1970 Fujita ..... 2/169
3,997,922 A * 12/1976 Huhta ..... 2/161.1
4,245,357 A * 1/1981 Connelly ..... 2/163
4,494,249 A * 1/1985 Hansson ..... 2/161.6
4,594,736 A 6/1986 Connelly
4,779,289 A * 10/1988 Prouty ..... 2/16
5,423,089 A 6/1995 Chun et al.
5,664,260 A 9/1997 Weiser
5,867,830 A 2/1999 Chen
6,154,885 A * 12/2000 Kobayashi et al. ..... 2/161.3
6,427,247 B1 * 8/2002 Suk ..... 2/161.2
6,732,378 B2 * 5/2004 Novak ..... 2/161.6
6,760,924 B2 * 7/2004 Hatch et al. ..... 2/161.5
7,062,791 B2 * 6/2006 Gold ..... 2/161.6
2004/0148679 A1 * 8/2004 Garneau ..... 2/159

* cited by examiner

*Primary Examiner* — Katherine Moran
(74) *Attorney, Agent, or Firm* — Boyle Fredrickson, S.C.

(57) ABSTRACT

The present invention is a glove formed with a palm portion having a section of the material forming the palm portion cut out or away from the palm portion and replaced by a replacement section formed of a stretchable material. The replacement stretchable material section has an area or shape significantly different from that of the cutout section removed from the palm portion, but has an outer periphery that corresponds in length to the length of the cut out portion. Thus, the replacement section, when attached to the periphery of the cut out portion of the palm portion, is attached thereto in a tensioned or stretched configuration to provide contouring to the palm portion of the glove in conformance with the shape of a hand of the individual. This significantly reduces wrinkling and/or bunching of the palm portion when the hand is extended or contracted from the relaxed position.

15 Claims, 3 Drawing Sheets

14'
10'
12'
C1

10
14
28
26
24
22
20

GLOVE WITH NON-BUNCHING PALM CONSTRUCTION

CROSS REFERENCE TO RELATED APPLICATIONS

This application claims priority from U.S. Provisional Patent Application Ser. No. 60/974,230, filed on Sep. 21, 2007, and incorporated herein by reference in its entirety.

FIELD OF THE INVENTION

The present invention relates to glove for various uses and more particularly to a glove including a palm portion including a wrinkle or fabric-bunching reducing portion, a back portion and a number of finger portions to receive the hand of a wearer therein.

BACKGROUND OF THE INVENTION

Gloves have a wide variety of constructions that are utilized to enable the glove to closely conform to the shape of the hand of the individual wearing the glove. The ability of a glove to conform to the wearer's hand is normally determined by the particular material utilized in the construction of the glove. More particularly, certain types of materials have inherent properties that enable the materials to more or less closely conform to the shape of the hand of an individual positioned within the glove.

For example, when a glove is formed of a natural material, such as leather, a glove will stretch only a limited amount conform to the hand position within the glove as a result of the natural properties of the material, which do not provide a significant amount of stretching to the material. In contrast, other, more flexible or elastic materials, such as Spandex® or Lycra®, have properties that enable these types of materials to stretch much more than natural materials.

However, regardless of the particular material utilized to form a glove, oftentimes the glove does not adequately conform to the shape of the hand of the wearer for various reasons, such as the material or materials forming the glove, or the shape of the glove or the shape of the hand of the wearer, among others. In these situations where the glove does not conform to the hand of the wearer, a shown in FIG. 4, when the glove 10' is flexed by the movement of a hand therein, the material forming the glove will create wrinkles 14' or bunch, particularly across the palm 12' of the glove, causing significant problems with regard to the ability of the individual to grasp or hold objects while wearing the glove 10'. In addition, this bunching 14' will cause premature and uneven wear of certain parts of the glove 10', namely those portions 16' that are urged outwardly due the bunching of the glove material, thereby lessening the effective life of the glove 10'.

In order to form a glove construction that more adequately adapts to the shape of a wearer's hand to reduce the bunching or wrinkling of the glove when in use, various alternative glove constructions have been developed. These constructions include gloves designed through the use of various measurements taken around the hand of an individual, as disclosed in Weiser U.S. Pat. No. 5,146,627. These measurements are utilized to design a glove that has an oval cross-section around the palm of the glove that closely conforms to the palm of the hand in order to prevent this material covering the palm from wrinkling or bunching while the individual closes his or her hand within the glove.

However, this process and glove design has significant drawbacks in that it requires detailed measurements to be taken of the hand, and requires that the glove be formed of two components stitched together along this oval cross-section, such that the seam is positioned directly across the palm of the glove in a highly undesirable position.

In addition, other glove constructions have been developed to reduce the bunching or wrinkling of a glove that utilize a single aperture formed in the glove material on the palm, such disclosed in Chen U.S. Pat. No. 5,867,830. This aperture, which can be covered by a strip or section formed of a suitable lining material, allows for the contraction of the material forming the palm of the glove to essentially open and close the apertures when the glove is flexed between closed and extended positions, thereby diminishing the amount of wrinkling or bunching of the material.

However this revised glove construction does not adequately address the problem of the bunching of the glove material, as the aperture only provides a limited amount of space for the glove material to be compressed prior to the material bunching as in prior glove designs. Additionally, the material strip attached to the glove to cover the apertures often bunches inwardly when the material forming the palm of the glove is contracted, thereby causing an additional bunching problem when utilizing the glove.

Therefore, it is desirable to develop a new glove construction that will not significantly wrinkle or bunch when the glove is flexed by an individual wearing the glove. It is also desirable that the ability of the glove to avoid bunching and winkling extend through the shell of the glove to any liner or insulating layer of the glove as well.

SUMMARY OF THE INVENTION

According to one aspect of the present invention, a glove construction is provided in which the glove is formed with a palm portion formed of a conventional glove material, and a portion formed of a stretchable material. The palm portion is initially formed in a conventional manner but has a part of the material forming the palm portion removed, with the stretchable material portion configured to take the place of the part of material removed from the palm portion. However, the particular configuration of the replacement portion is not identical to the part of the conventional material section that is removed from the palm portion. Thus, in order to secure the replacement section to the palm portion, the replacement section, and optionally the palm portion of the glove, must be pre-shaped or otherwise manipulated to be able to be joined to one another along the perimeter for each section. In this manner, the glove is formed with an inherent shape that conforms to the actual shape of an individual's hand when positioned on the hand. Further, as a result of the stretchable nature of the material forming the replacement section, the replacement section allows for the palm portion to expand and contract in conjunction with the movement of the individuals hand within the glove to maintain a close conformance of the glove with the surface of the hand of the wearer. As a result, the palm portion of the glove does not have any significant wrinkling or bunching of the conventional material section or the replacement material section regardless of the positioning of the hand within the glove.

According to another aspect of the present invention, multiple parts of the conventional material forming the palm portion, or optionally in any of the back, finger or thumb portions, can be removed and replaced by sections of the more flexible or stretchable material to provide the glove of the present invention with an even greater ability to conform to the shape of the hand of the individual in the extended and/or contracted positions. The presence of the multiple replacement material sections allows each section to conform to the shape of the hand of the wearer separately from one another. Further, each replacement section can be shaped according to the particular location on the glove where the section is to be positioned, such that the replacement sections provide a desired pre-curved shape or contour to the glove that conforms to the shape of a relaxed hand of the wearer, while also allowing for expansion and contraction of the glove as result of movement of the hand.

According to still another aspect of the present invention, the replacement sections can be utilized in the shell of a glove, as well as any liner and insulating layer for the glove that may be present in the glove construction. By including the replacement sections in each of the layers of the glove, it is possible to maintain the reduction in wrinkles and bunching throughout the entire glove construction, as opposed to only on the exposed shell.

Numerous other aspects, features and advantages of the present invention will be made apparent from the following detailed description taken together with the drawing between figures.

BRIEF DESCRIPTION OF THE DRAWINGS

The drawings illustrate the best mode currently contemplated for practicing the present invention.

In the drawings.

DETAILED DESCRIPTION OF THE INVENTION

Figure 1:
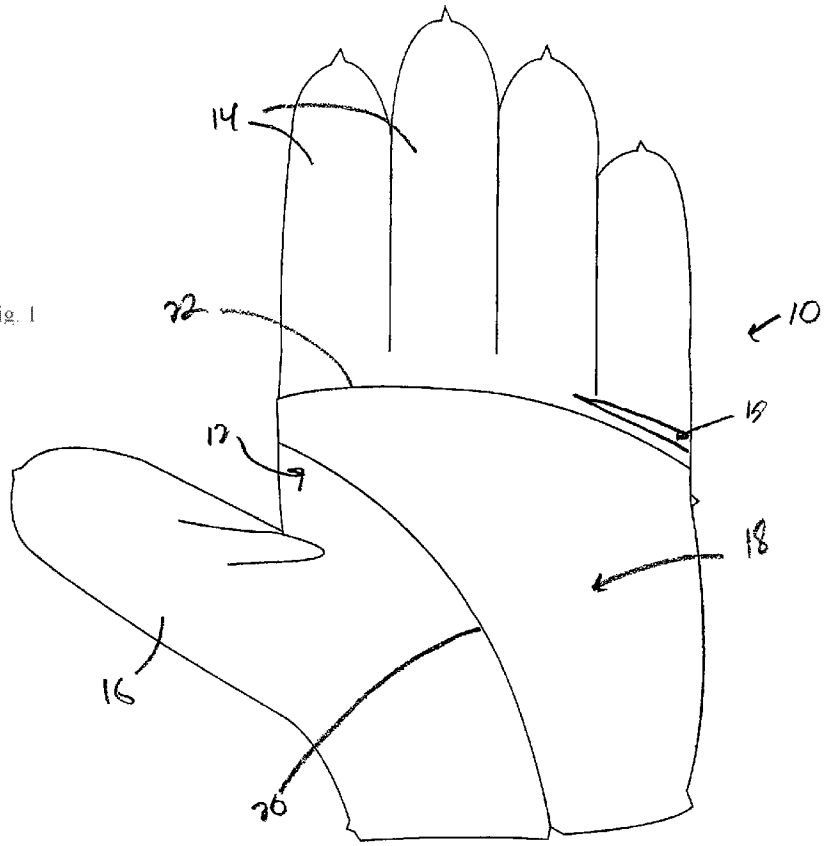
FIG. 1 is a front plan view of a conventional palm portion that is modified in the construction of a glove constructed according to the present invention.

With reference now to the drawing figures in which like reference numerals designate like parts throughout the disclosure, a palm portion to be utilized in the construction of a glove according to the present invention is indicated generally at 10 in FIG. 1. The palm portion 10 is formed in any conventional manner from any suitable material and includes a palm section 12 from which extend a number of finger sections 14, and a thumb section 16. The palm portion 10 is configured to be attached to a similarly-shaped back portion (not shown) in any suitable manner, such as by stitching, adhering or bonding, to form the glove. Alternatively, the palm portion 10 can be formed with any combination of finger sections 14 and the thumb section 16 to accommodate gloves to be utilized in various manners where different arrangements of these sections 14 and 16 are required or omitted. Concerning those materials from which the palm portion 10 can be formed, the palm portion 10 can be formed of any suitable glove-making material, such as natural and/or synthetic materials, including leather, synthetic leather, cotton, and other suitable materials as well as combinations thereof.

The palm portion 10 as formed also defines a cutout section 18 that, in a preferred embodiment of the present invention, is defined by a lower edge 20 that extends from the side of the palm portion 10 adjacent the thumb section 16 along a curved path across the palm section 12 to terminate approximately at the midpoint of the palm section 12 located opposite the finger section 14, and an upper edge 22 that extends across the palm section 12 along a line generally conforming to the shape of the finger sections 14. This preferred configuration for the cutout section 18 generally covers the area of the palm section 12 that becomes compressed when the palm section 12 is compressed as a result of the movement of a hand positioned within the glove formed with the palm portion 10. However, the particular shape of the cutout section 18 located between the finger sections 14 and the thumb section 16 can be modified as desired to accommodate different glove configurations.

In this preferred configuration, the cutout section 18 is separated from the remainder of the palm portion 10 by cutting the material forming the palm portion 10 along the lines formed by the lower edge 20 and upper edge 22 of the cutout section 18 in any suitable manner. Once cut along these edges 20 and 22, the cutout section 18 is removed in its entirety, which effectively divides the palm portion 10 into a thumb portion 100 and finger portion 102, as best shown in FIG. 2.

Figure 2:
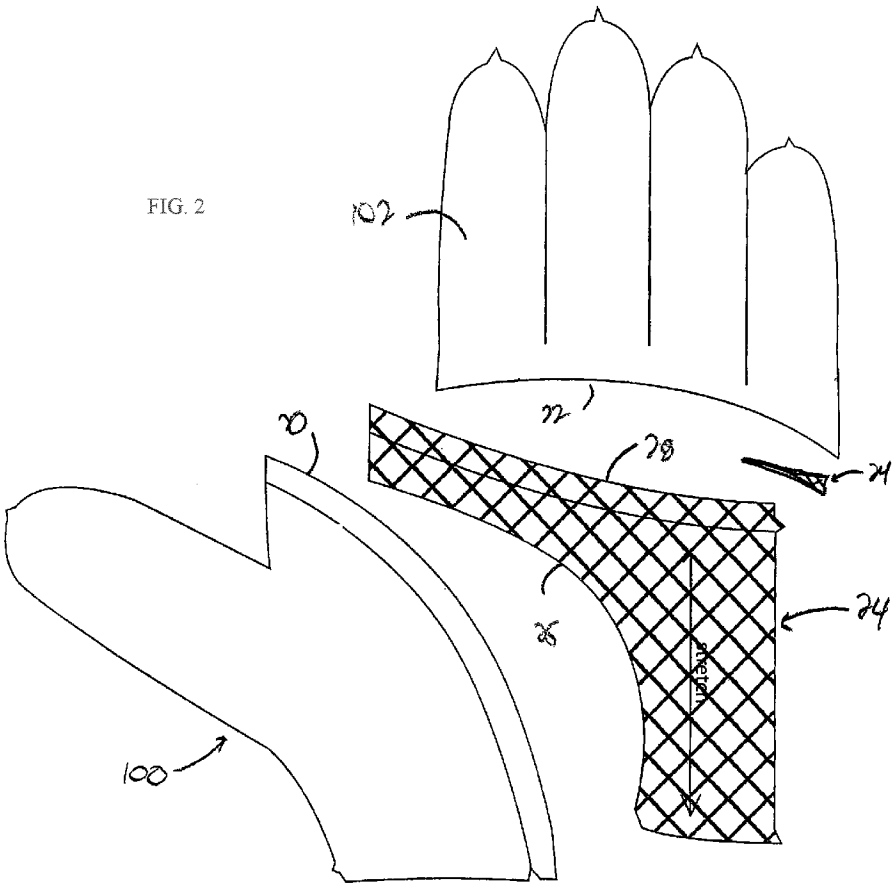
FIG. 2 is a front plan view of a the palm portion of the glove and a replacement material section utilized to replace a part of the palm portion of FIG. 1.
Figure 4:
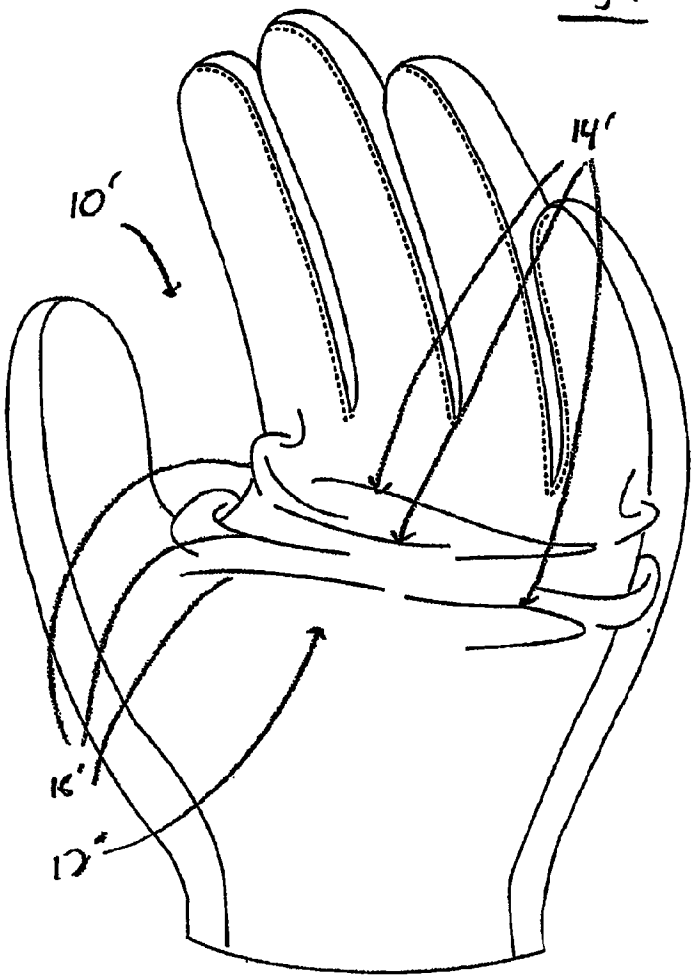
PRIOR ART Fig. 4
FIG. 4 is a perspective view of a prior art glove illustrating the bunching that occurs when the glove is in a compressed position.

After the cutout section 18 is removed from the palm portion 12, a replacement section 24, best shown in FIG. 2, is positioned between the thumb portion 100 and the finger portion 102 within the palm portion 10. The replacement section 24 has a different shape than the cutout section 18, such that the replacement section 24 does not conform exactly to the edges 20 and 22 on the thumb portion 100 and the finger portion 102, respectively, left by the removal of the cutout section 18. As an important attribute of the replacement section 24, while the replacement section 24 has a shape generally conforming to the shape of the cutout section 18, the replacement section 24 is preferably formed with a pair of inwardly curving sides 26 and 28 positioned adjacent the edges 20 and 22, respectively. More preferably, the length of each side 26 and 28 of the replacement section 24 corresponds in a 1:1 ratio to the length of the adjacent edges 20 and 22 left by the removal of the cutout section 18. This allows both sides 26 and 28 of the replacement section 24 to be secured along their entire lengths to the exposed edges 20 and 22 of the thumb portion 100 and the finger portion 102. However, for certain desired configurations for the palm portion 10, such as for palm portions 10 to be used in forming gloves having a requirement for more or less stretching in the palm portion 10, the length ratio of the sides 26 and 28 to the edges 20 and 22 can be greater or less than 1:1 to facilitate or restrict the compression or stretching of the replacement section 24.

Figure 3:
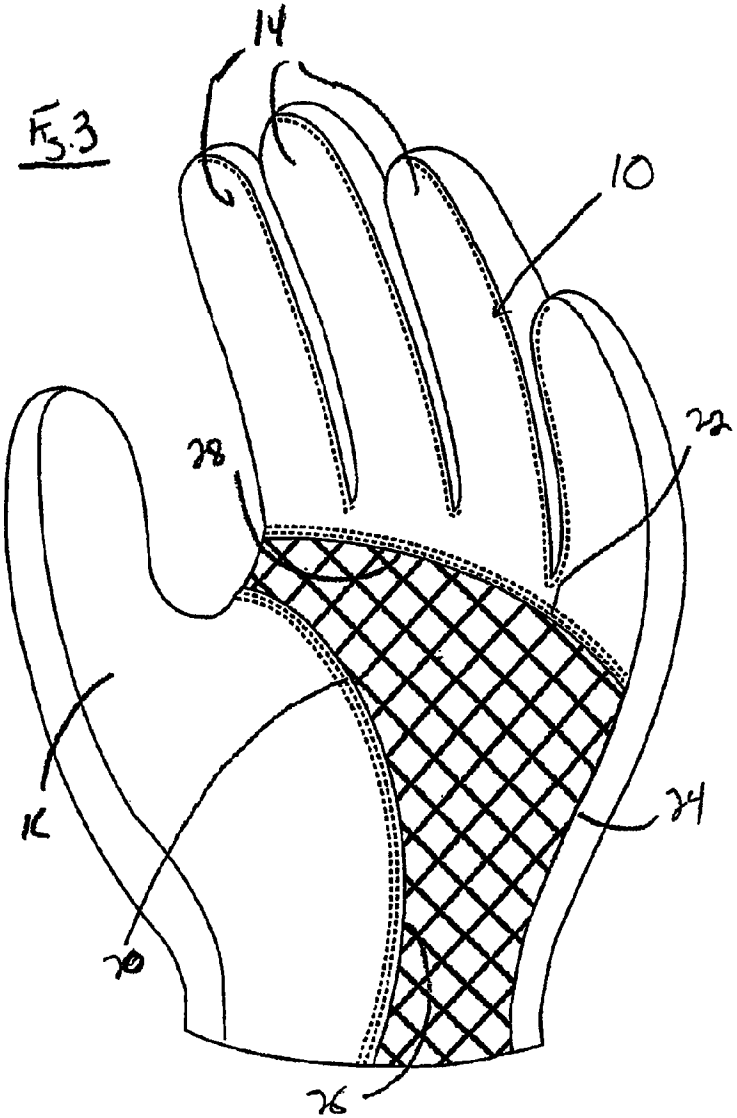
FIG. 3 is a perspective view of a glove including a palm portion having a pair of replacement material sections attached thereto.

Due to the ability of the material forming the replacement section 24 to flex in any desired manner, such as along a single axis or biaxially or in multiple directions, to secure the sides 26 and 28 of the replacement section 24 to the edges 20 and 22, the section 24 is shaped to enable the sides 26 and 28 to be positioned in alignment with the edges 20 and 22. In doing so, the replacement section 24 is shaped into a configuration that provides an amount of reshaping or contouring to the palm portion 10 and consequently to the glove formed using the palm portion 10. Preferably, because the replacement section 24 is shaped to secure the sides 26 and 28 to the adjacent edges 20 and 22, once the replacement section 24 is secured to the thumb section 100 and finger section 102, the section 24 is maintained in a shaped state as a result of this engagement, and the engagement of the replacement section 24 with the remainder of the glove causes the palm section 10 to curve as the replacement section 24 draws the thumb section 100 and finger section 102 towards one another. Consequently, the contouring provided by the replacement section 24 shapes the palm portion 10 to conform to the shape of a relaxed hand of a wearer, i.e., a hand that is not fully opened or extended, as best shown in FIG. 3. As a result, the use of the stretchable material to form the replacement section 24 provides a glove constructed with the palm portion 10 to be initially formed with a contour that closely resembles the shape of a relaxed hand to be inserted within the glove. However, because the contour provided by the replacement section 24 occurs when the section 24 is in a stretched or tensioned state due to the connection of the section 24 to the remainder of the palm portion 10 and the glove, that the material forming the replacement section 24 is maintained in a smooth configuration, and does not bunch sufficiently to have any significant wrinkling present in the replacement section 24 in this state. Further, when the palm portion 10 is compressed by the hand of an individual, the replacement section 24 is moved into a less tensioned state as the hand is closed, but the engagement of the section 24 with the remainder of the palm portion 10 keep a certain amount of tension in the section 24, so that the section 24 remains generally smooth and unwrinkled even when the palm portion 10 and glove are fully compressed. In this manner, the stretchable nature of the replacement section 24 allows the section 24 to be secured to the palm portion 10 in a manner that allows the section 24 stretch when the individual extends the hand within the glove formed with the palm portion 10, but which also maintains an amount of stretch in the material forming the replacement section 20 such that the material of the replacement section 24 does not substantially wrinkle or bunch when the individual contracts the glove including the palm portion 10.

Further, the particular shape of the replacement section 24 not only corresponds to the cutout section 18 with regard to the length of the sides 26 and 28 of the replacement section 24, but the replacement section 24 is also designed to have a shape that allows the stretchable material forming the replacement section 18 to be shaped in a two and/or three dimensional manner which significantly reduces the bunching of the material forming the replacement section 24. In particular, the section 24 can be formed of a material that has a thickness less than that of the remainder of the palm portion 10. This reduces the volume of material present in the area of the replacement section 24, such that the presence of the section 24 further reduces the potential for bunching when the palm portion 10 is compressed by the hand of an individual. In addition, when gloves are constructed that include multiple layers, such as a shell, a liner and an insulation layer, or any combination of these layers, a replacement section 24 can be utilized in each of these layers to maintain the ability of the glove formed with these layers to compress and substantially prevent wrinkles or bunching from occurring in any of the layers of the glove.

In an alternative embodiment of the palm portion 10, the palm portion 10 can be formed multiple replacement sections 24. Each of the replacement sections 24 are formed with inwardly curved, outwardly curved or straight sides (not shown), or a combination thereof, that conform to the length but not necessarily to the shape of the adjacent edges, e.g., 20 and 22, and are located across the palm section 12 in locations generally similar to the single replacement section 24 of the embodiment shown in the drawing figures, but the sections 24 are disposed on opposite sides of a central original material section (not shown) such that the majority of the palm portion 10 is formed from the original material in order to provide the palm portion 10 with the benefits of the original material utilized in the palm portion 10 construction. Additionally, the palm portion 10 can be formed with additional replacement sections 24 disposed at various other areas of the palm portion 10, such as on the thumb section 12 and one or more of the finger sections 14, as desired.

Also, the replacement section 24 can initially be stretched, in one, two or three dimensions, to conform the sides 26, 28 of the section 24 to the edges 20, 22 of the thumb section 100 and finger section 102 and then be secured thereto. Once secured, the section 24 is released such that the section 24 reverts to its former configuration, thereby drawing the thumb section 100 and finger section 102 into a non-planar configuration for the palm portion 10.

Various alternatives are contemplated as being within the scope of the following claims particularly pointing out in distinctly claiming subject matter regarded as the invention.

What is claimed is:

1. A glove construction to reduce wrinkling of the glove on a hand, the glove comprising:

(a) a palm portion adapted to be positioned to cover the palm of the hand of a wearer, the palm portion formed of a glove-making material and having at least one cutout section formed therein across the palm portion, the cutout section dividing the palm portion into a finger portion and a thumb portion and having a peripheral edge; and (b) at least one replacement section secured to the palm portion, wherein the at least one replacement section has a thickness less than that of the cutout section and at least one side having a peripheral length approximately equal to that of a corresponding edge of the at least one cutout section to which the at least one replacement section is secured but an oppositely contoured peripheral shape than the edge of the at least one cutout section, wherein the at least one side of the at least one replacement section is stretched to conform the peripheral shape of the at least one side of the at least one replacement section to the peripheral shape of the edge of the at least one cutout section prior to the at least one replacement section being secured to the palm portion, and wherein the at least one replacement section contracts after attachment to the palm portion to provide a pre-curved shape to the palm portion that conforms to the shape of a relaxed hand of a wearer.

2. The glove of claim 1, wherein the at least one side of the at least one replacement section is secured to the palm portion in a deformed configuration.

3. The glove of claim 1 wherein the at least one replacement section is formed of a stretchable material, and the at least one side of the replacement section is shaped in three dimensions to conform to the peripheral shape of the at least one cutout section.

4. The glove of claim 3, wherein the at least one side of the at least one replacement section is secured to the palm portion in the shaped configuration.

5. The glove of claim 1 wherein the at least one replacement section has at least one inwardly curving side that is shaped to conform to the peripheral shape of the at least one cutout section.

6. The glove of claim 5 wherein the at least one replacement section further comprises a pair of opposed inwardly curving sides.

7. The glove of claim 5 wherein the peripheral shape of the at least one cutout section includes at least one outwardly curving edge to which the at least one inwardly curving side of the at least one replacement section is tensioned and secured.

8. The glove of claim 1 further comprising:

(a) the at least one cutout section having at least two cutout sections formed in the palm portion; and (b) the at least one replacement section having at least two replacement sections secured to the palm portion within the at least two cutout sections of the palm portion, wherein the peripheral shape of the at least two cutout sections includes at least one outwardly curving edge to which at least one inwardly curving side on each of the at least two replacement sections are shaped and secured.

9. The glove of claim 1 wherein the palm portion forms a portion of a layer of the glove selected from the group consisting of a shell, a liner and an insulation layer.

10. A palm portion adapted to be used in forming a glove to cover the palm of a hand of a wearer, the palm portion comprising at least one replacement section secured to the palm portion within at least one cutout section formed in the palm portion and having a peripheral edge, the at least one replacement section dividing the palm portion into a finger portion and a thumb portion, wherein the at least one replacement section that is secured to the palm portion is formed of a stretchable material and has an oppositely contoured peripheral configuration from the at least one cutout section, wherein the at least one replacement section has a thickness less than that of the cutout section and is stretched to conform the peripheral shape of the at least one replacement section to the at least one cutout section prior to the at least one replacement section being secured to the palm portion and wherein the at least one replacement section contracts after attachment to the palm portion to provide a pre-curved shape to the palm portion that conforms to the shape of a relaxed hand of a wearer.

11. The palm portion of claim 10 wherein the peripheral shape of the at least one cutout section includes at least one outwardly curving edge to which at least one inwardly curving edge on the at least one replacement section is secured.

12. A method for forming a non-bunching glove for a hand, the method comprising the steps of:

(a) providing a palm portion adapted to be positioned to cover the palm of the hand of a wearer, the palm portion formed of a glove-making material;

(b) removing at least one cutout section in the palm portion across the palm portion, the removal of the at least one cutout section dividing the palm portion into a finger portion and a thumb portion and creating at least one outwardly curving edge in the palm portion;

(c) forming at least one replacement section with a thickness less than that of the cutout section and having at least one inwardly curving edge with an oppositely contoured peripheral configuration from the at least one cutout section;

(d) stretching the at least one inwardly curving edge of the at least one replacement section to conform to the at least one outwardly curving edge of the least one cutout section; and (e) securing the at least one inwardly curving edge of the at least one replacement section to the at least one outwardly curving edge of the palm portion in a shaped configuration to provide a pre-curved shape to the palm portion that conforms to the shape of a relaxed hand of a wearer.

13. The method of claim 12 wherein the at least one replacement section is formed of a stretchable material, and wherein the step of securing the at least one replacement section comprises deforming the at least one inwardly curving edge to overlap the at least one outwardly curving edge on the palm portion, and securing the inwardly extending edge to the outwardly extending edge.

14. A glove construction to reduce wrinkling of the glove on a hand, the glove comprising:

(a) a palm portion adapted to be positioned to cover the palm of the hand of a wearer, the palm portion formed of a glove-making material and having at least one cutout section formed within the palm portion and having a peripheral edge, the at least one cutout section dividing the palm portion into a completely separate finger portion and a thumb portion; and (b) at least one replacement section secured to the palm portion, wherein the at least one replacement section has a thickness less than that of the cutout section and at least one side having a peripheral length approximately equal to that of a corresponding edge of the at least one cutout section but an oppositely contoured peripheral shape than the corresponding edge of the at least one cutout section to which the at least one side of the at least one replacement section is secured, wherein the at least one side of the at least one replacement section is stretched to conform the peripheral shape of the at least one side of the at least one replacement section to the peripheral shape of the edge of the at least one cutout section prior to the at least one replacement section being secured to the palm portion, and wherein the at least one replacement section contracts after attachment to the palm portion to provide a pre-curved shape to the palm portion that conforms to the shape of a relaxed hand of a wearer.

15. The glove construction of claim 14 wherein the peripheral shape of the at least one cutout section includes at least one inwardly curving edge to which at least one inwardly curving edge on the at least one replacement section is secured.

* * * * *